United States Patent [19]

Szymski et al.

[11] Patent Number: 5,046,723

[45] **Date of Patent: * Sep. 10, 1991**

[54] BOX BEAM BICYCLE TYPE FRAME

[75] Inventors: Eugene J. Szymski, Skokie; Rene Mraz, Evanston, both of Ill.

[73] Assignee: Schwinn Bicycle Company, Chicago, Ill.

[ * ] Notice: The portion of the term of this patent subsequent to Jun. 26, 2007 has been disclaimed.

[21] Appl. No.: 490,940

[22] Filed: Mar. 8, 1990

[51] Int. Cl.[5] ..... A63B 21/00

[52] U.S. Cl. ..... 272/73

[58] Field of Search ..... 272/73, DIG. 6, 129; D21/191, 194; D12/110, 111; 273/80 B, 73 C; 280/289 G, 274, 260, 281 R

[56] References Cited

U.S. PATENT DOCUMENTS

| | | | |
|---|---|---|---|
| D. 243,165 | 1/1977 | Wheeler | D12/11 |
| D. 275,589 | 9/1984 | Gustafsson | D21/194 |
| 3,596,921 | 8/1971 | Bruckl | 273/80 B |
| 3,861,715 | 1/1975 | Mendoza | 280/260 |
| 4,936,570 | 6/1990 | Szymski | 272/73 |

*Primary Examiner*—Stephen R. Crow

*Attorney, Agent, or Firm*—McCaleb, Lucas & Brugman

[57] ABSTRACT

Frame for a bicycle type apparatus such as a bicycle type exerciser or a bicycle, having a closed, rectangular box beam cross section reach tube oriented with the major axis of the cross section in a vertical plane secured between a handlebar head tube and a seat mast. The reach tube has an angular configuration including a rear horizontal section extending along the chain guard, and an upwardly and forwardly extending diagonal section.

2 Claims, 2 Drawing Sheets

BOX BEAM BICYCLE TYPE FRAME

BACKGROUND OF THE INVENTION

This invention relates generally to bicycle type apparatus and more particularly to bicycle type exercisers, although it may be equally applicable to the upwardly open type frame used on girls' and ladies' bicycles.

Two important factors in frame design for bicycle type exercisers are leg room and vertical stiffness.

Bicycle type exercisers are stationary but otherwise similar in many respects to bicycles and use some of the same parts. A frame similar to that on an upwardly open girls' or ladies' bicycle is often used, having twin, parallel, curved reach tubes. It provides ample leg room for older or overweight persons and those who are not athletically proficient to be seated in an exercising position without lifting a leg above a high bar. One example is shown in FIG. 1 of U.S. Pat. No. 3,664,027 issued May 23, 1972, to Albert J. Fritz and Rudolph L. Schwinn. A further example of that prior art construction is shown in FIGS. 5 and 6.

It is important to the comfort and well-being of the user that the frame be absolutely rigid and free from noticeable vertical deflection and sidewise whippiness in operation. In practice, this is difficult to achieve with the above-mentioned conventional upwardly open frame.

Many people who find bicycle type exercisers beneficial lack the athletic dexterity required to ride a real bicycle. Due to age, arthritis-stiffened joints, excess weight or other condition for which an exercise bike is recommended, a person may not be able to lift his or her leg very high off the floor to mount or dismount. Some who find it difficult or impossible to ride bicycles use bicycle type exercisers regularly. For them it is important that it be easy to mount and dismount. Maximum leg room is essential to prevent tripping on the frame. Unfortunately, increasing leg clearance above the chain guard by simply lowering the reach tube or making it with a smaller cross section reduces the vertical rigidity of the frame. This is well known to designers and manufacturers of this equipment.

Accordingly, prior to the present invention, attempts to increase leg clearance by moving the reach tube down toward the chain guard have always included a supplemental connection of some kind between the seat mast and handlebar head tube. A single reach tube without such a supplemental connection has never been considered practical.

The above-mentioned U.S. Pat. No. 3,664,027 with twin reach tubes is an example of designers' unwillingness to rely on a single reach tube. Each reach tube, in effect, acts as a supplemental stiffening strut for the other.

Other attempts to maximize leg room by an upwardly open frame below the seat, but using separate stiffening struts of one kind or another to obtain the desired vertical rigidity, are shown in Gustafson Design U.S. Pat. No. 275,589, Philbin U.S. Pat. No. 3,833,216 and Wolfa U.S. Pat. No. 3,995,491.

SUMMARY OF THE INVENTION

This invention provides a frame of less weight and more strength and rigidity for bicycle type apparatus of the kind described.

A primary object of the present invention is to eliminate the extra cost and weight of the supplemental stiffening struts and provide a single one-piece reach tube having greater vertical rigidity and less weight and cost than the multiple-element reach tube arrangements heretofore used.

An object of the invention is to provide a reach tube having a vertically elongated cross section in which the area moment of inertia $I_{x\text{-}x}$ about the horizontal axis is substantially greater than the area moment of inertia $I_{y\text{-}y}$ about the vertical axis.

In effect, this invention substitutes a single, closed rectangular box beam cross-section reach tube for the twin, parallel, curved reach tubes disclosed in the above-mentioned U.S. Pat. No. 3,664,027.

As a result, verified by actual load-deflection tests, the new frame uses less steel and is substantially twice as rigid in resisting vertical loads applied to the seat mast as the conventional frame shown in the above patent.

There is provided in accordance with the present invention, an improvement in a bicycle type reach tube, which extends forwardly from the seat tube to the head tube and provides the main structural connection therebetween. The present invention is characterized in that in each cross section along the length of the reach tube the area moment of inertia $I_{x\text{-}x}$ about the horizontal axis is substantially greater than the area moment of inertia $I_{y\text{-}y}$ about the vertical axis. As used above and throughout this document, the terms "horizontal axis" and "vertical axis" for any particular cross section shall be understood to refer to mutually perpendicular neutral axes that lie in a plane perpendicular to the longitudinal axis of the reach tube. When the apparatus stands upright on a level surface, the vertical axis of any cross section referred to in this document is in a vertical plane in the strict sense even through the longitudinal axes in different sections of the reach tube are respectively horizontal and non-horizontal, and the horizontal axis referred to in this document is perpendicular to that vertical plane.

The deflection of a particular point on a structural member subject to a bending moment is inversely proportional to the area moment of inertia of its cross section about the neutral axis perpendicualr to the bending force or a component thereof. Accordingly, in the present invention, a large area moment of inertia $I_{x\text{-}x}$ about the horizontal neutral axis results in a small deflection, that is, greater vertical rigidity, due to vertical loading. Conversely, a lesser area moment of inertia $I_{y\text{-}y}$ about the vertical neutral axis, according to the present invention, allows a somewhat greater horizontal deflection due to horizontal loading while still maintaining sufficient horizontal rigidity to prevent excessive cyclic side bending and twisting ("whippiness") when work is applied to the frame through the pedals.

For a reach tube having a particular cross-sectional area to provide the tensile and compressive strengths needed, the present invention while recognizing the importance of rigidity in both directions, further recognizes that less rigidity is needed in the horizontal direction than in the vertical direction. Accordingly, for a reach tube of a given cross-sectional area, the present invention in effect "trades off" some unneeded horizontal rigidity to provide additional vertical rigidity. This trade off is however kept within limits to prevent excessive sidewise flexibility and twistability which could detract from the solid feel of the exerciser frame.

It is possible to trade horizontal rigidity for vertical rigidity by adjusting the ratio between $I_{x\text{-}x}$ and $I_{y\text{-}y}$ within limits in a number of ways, such as varying the wall thickness of a circular cross section tube or providing ribs internally or externally along the top or bottom, or both. It is presently believed, however, that the best and least costly way of favorably adjusting the ratio between $I_{x-x}$ and $I_{y-y}$ for a given cross-sectional area is to make it rectangular in cross-section and of substantially uniform wall thickness at each cross-section along its length, when compared with the higher costs of manufacturing more complex cross-sections.

According to the present invention, the preferred ratio of $I_{x-x}$ to $I_{y-y}$ at each cross-section along the length of the reach tube should be in the range of about 1:75/1 to 3.75/1. Within that range, an optimum ratio of 3/1 has been selected to illustrate and describe as a specific embodiment herein.

BRIEF DESCRIPTION OF THE DRAWINGS

In the drawings.

Like parts are referred to by like reference numerals.

DETAILED DESCRIPTION OF A SPECIFIC EXAMPLE OF THE PREFERRED EMBODIMENT

Figure 1:
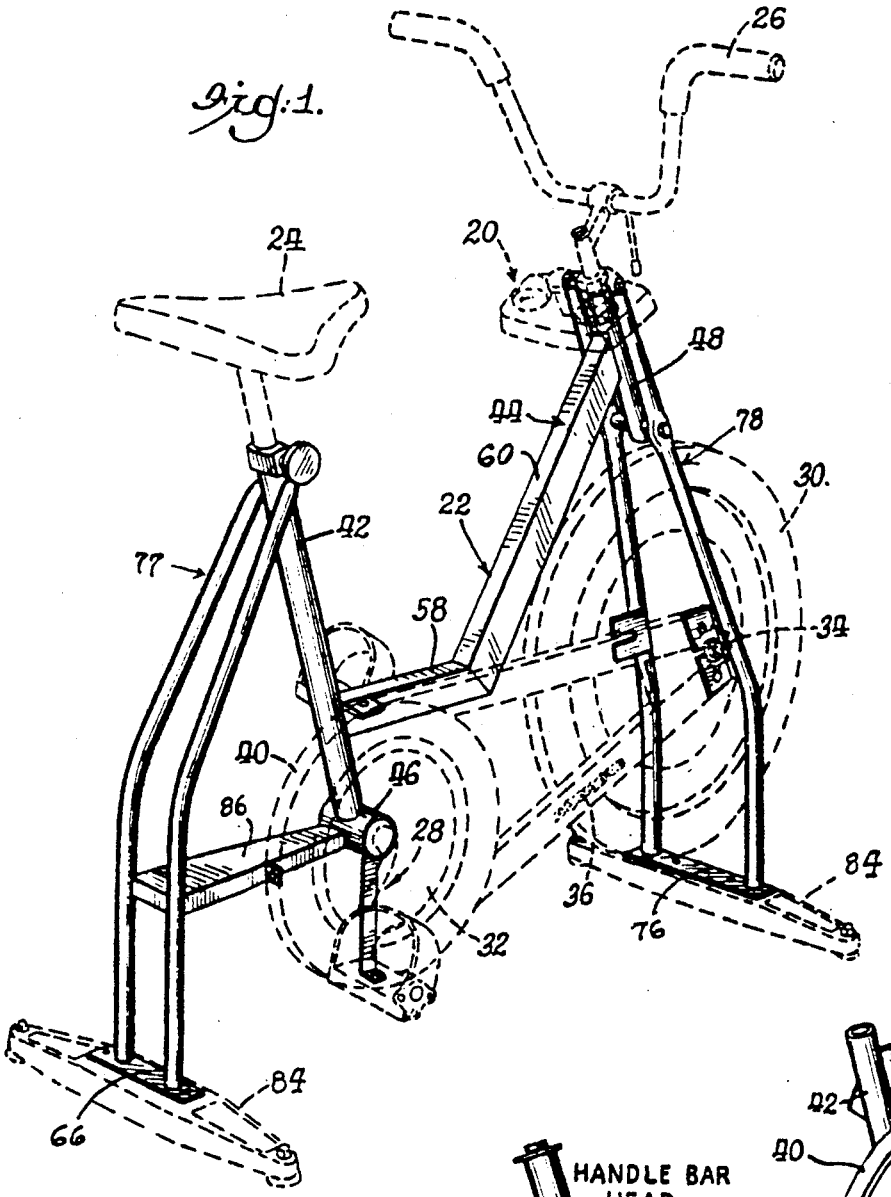
FIG. 1 is a perspective view of a bicycle type exerciser frame embodying this invention.

Referring now more particularly to the specific embodiment of the invention shown in the drawing, a stationary bicycle type exerciser generally designated 20 is shown.

The exerciser has a support frame generally designated 22, a saddle assembly 24, a handlebar assembly 26, a pedal and crank assembly 28 rotating an adjustable resistance friction wheel 30 through sprockets 32, 34, and a chain 36 protected by a chain guard 38 and a sprocket guard 40, all made and operating in a well-known manner.

Turning attention to the frame 22 which has increased strength and rigidity as a result of the present invention, it has the usual seat mast tube 42 extending upwardly and rearwardly from a crank hanger 46 to the saddle assembly 24, and a head tube 48 supporting the handlebar assembly 26. Rear and front fork assemblies 77 and 78 respectively include foot plates 66 and 76 mounted on floor-engaging feet 84. A horizontal bracket 86 connects the rear fork assembly to the crank hanger.

The crux of the present invention is the single reach tube 44 which forms part of the frame and has sufficient strength and rigidity to provide the sole structural connection between the handlebar head tube 48 and the seat mast 42; as contrasted with the prior art reach tubes mentioned above, all of which require supplemental supporting struts.

Figure 4:
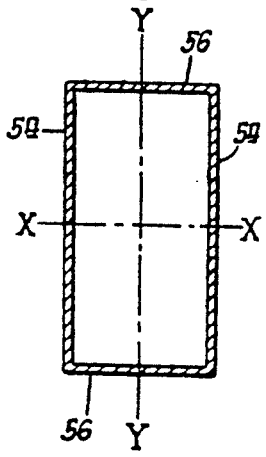
FIG. 4 is an enlarged cross-section of FIG. 3 taken on line 4—4.

The improved reach tube 44 comprises a closed, rectangular box beam, the cross-section of which is shown in FIG. 4. To provide the optimum ratio of approximately 3/1 between $I_{x-x}$ and $I_{y-y}$ and thereby maximize vertical rigidity for the weight of steel used without unduly reducing horizontal rigidity, and to facilitate securement by welding between the head tube 48 and seat mast 42, the cross-sectional dimension of the reach tube 44 along its entire length should be two inches along the vertical neutral axis Y-Y and one inch along the horizontal neutral axis X-X. Material is cold rolled steel 0.062" thick.

Other specific examples within the perferred range of $$\frac{I_{x-x}}{I_{y-y}} = 1/75/1 - 3.75/1$$

are as follows:

| CROSS-SECTION width × height × wall thickness | $I_{x-x}$ | $I_{y-y}$ | $\frac{I_{x-x}}{I_{y-y}}$ | lbs. steel per running inch |
|---|---|---|---|---|
| 1 × 1½ × .074" | .106 | .055 | 1.91 | .099 |
| 1 × 1½ × .120" | .155 | .079 | 2.19 | .153 |
| 1 × 2 × .083" | .238 | .078 | 3.05 | .133 |
| ¾ × 1.5 × .075" | .088 | .028 | 3.092 | .089 |

The reach tube 44 has an angular configuration in side view with a rear, horizontal section 58 welded at its rear end to the seat mast 42, and a front diagonal section 60 extending upwardly and forwardly and welded at its front end to the head tube 48.

Figure 2:
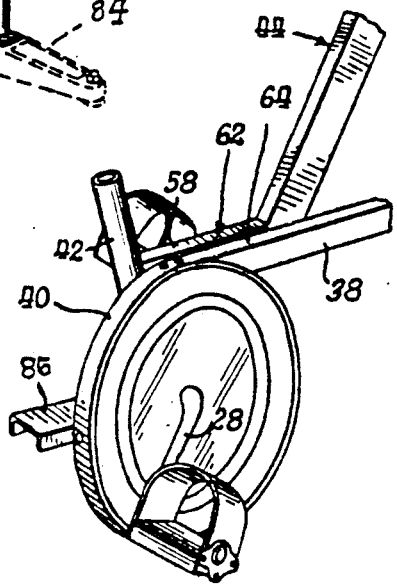
FIG. 2 is a fragmentary view of FIG. 1.
Figure 3:
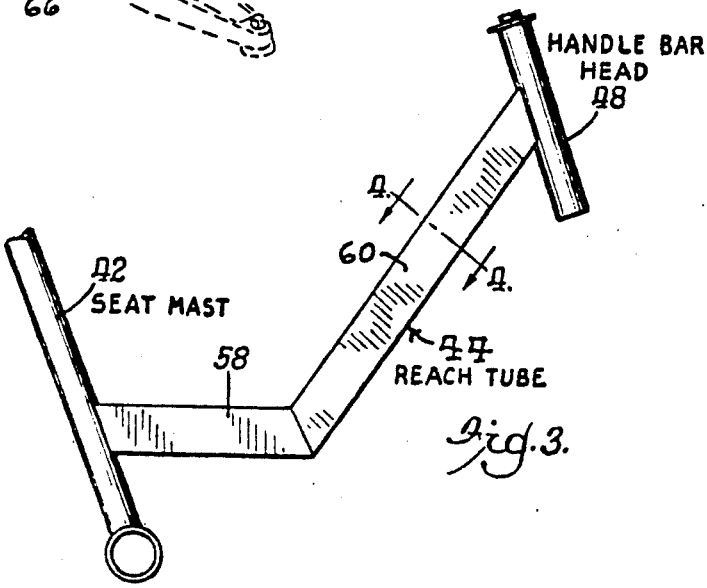
FIG. 3 is a fragmentary side view of FIG. 1.

Referring to FIG. 2, the top surface 62 of the horizontal reach tube section 58 extends along, and preferably at a level slightly above the upper surface 64 of the chain guard. It is not unusual for users to attempt to stand on the chain guard which is of relatively light weight metal or plastic material. With the present invention, the chain guard will be protected from that kind of abuse because most of the downward load applied by the user will be borne by the reach tube.

As will now be described, the improved rectangular cross-section reach tube 44 is cheaper, makes more efficient use of material, and is substantially twice as rigid vertically as the conventional pair of reach tubes 50, 52 shown in FIG. 5. Typically, the reach tubes 50, 52 are made of 0.062" thick round tube stock, 1.00" outside diameter, making a total cross-sectional area of 0.364 square inches and using 0.1026 lbs. of steel per running inch. By comparison, as described above, the reach tube 44 is made of 0.062" thick rectangular tube stock 2"×1" in outside cross section, making a total cross-sectional area of only 0.356 square inches, and using only 0.1004 lbs. of steel per running inch.

Figure 5:
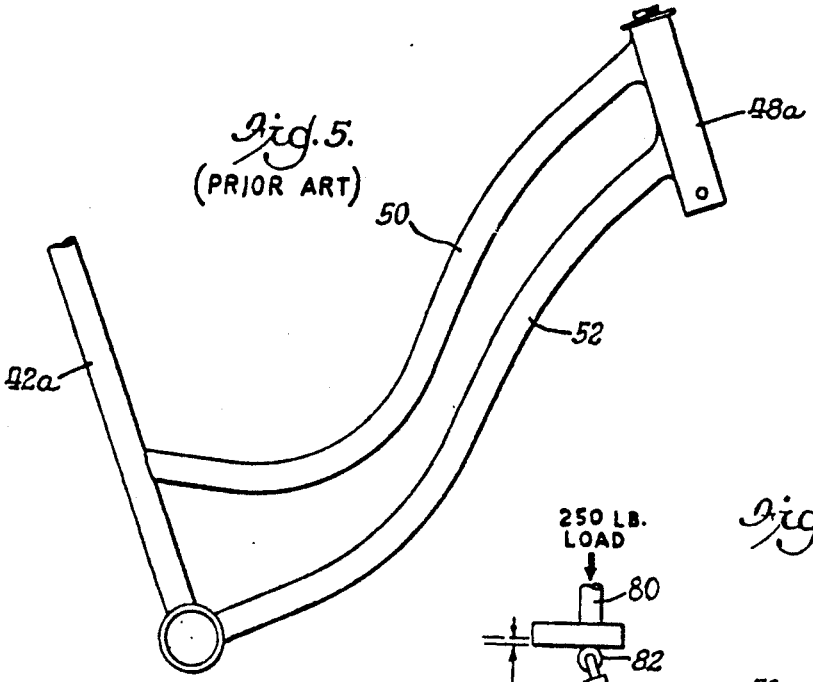
Fig. 5. (PRIOR ART)
FIG. 5 is a view similar to FIG. 3 of a curved, twin reach tube arrangement representing the prior art shown in the above-mentioned U.S. Pat. No. 3,664,027.
Figure 6:
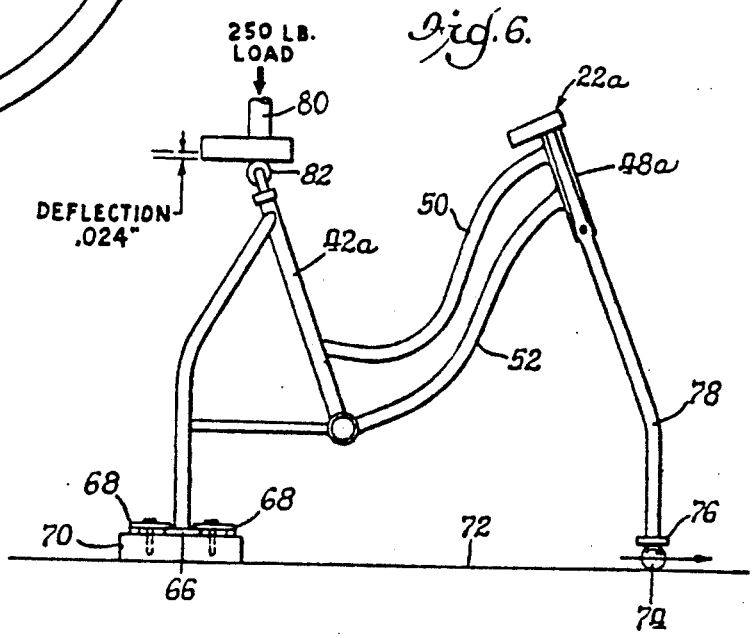
FIGS. 6 and 7 are schematic side views of testing apparatus used in demonstrating and measuring the improved rigidity of the frame of the present invention compared with that of the conventional prior art frame shown in the above-mentioned patent.

Thus, the improved reach tube 44 actually uses slightly less steel than the prior conventional reach tube pair 50, 52 shown in FIGS. 5 and 6. The improved reach tube is dramatically stronger and more rigid in the vertical direction as verified by actual tests which will now be described in connection with FIGS. 6 and 7.

As shown in FIG. 6, a frame **22*a* using conventional twin reach tubes 50, 52 with the dimensions described above was tested for vertical rigidity clamping the rear foot plate 66 down by clamp means 68 to block 70 fixed to floor 72 in any suitable manner. A roller 74 was placed between front foot plate 76 and the floor so the front fork assembly 78 was free to deflect forwardly under load. A press 80 was loaded downwardly with a load of 250 lbs. applied to a roller 82 mounted at the top of the seat mast tube 42***a* simulating the weight of a 250 lb. operator. Downward deflection of the roller 82, simulating deflection of the saddle assembly 24 under this loading was measured as 0.024".

Figure 7:
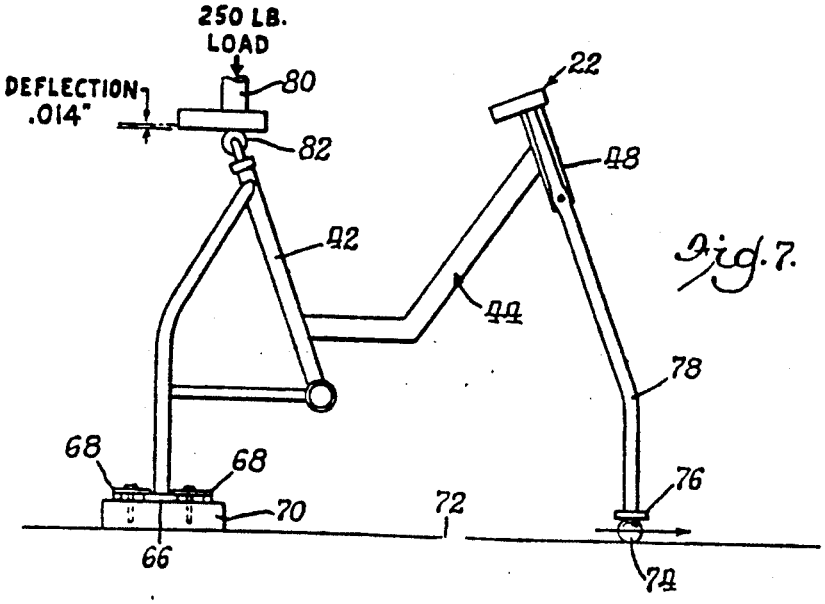

Under exactly the same conditions as shown in FIG. 7, the frame 22 with the improved single tube reach tube 44 deflected only 0.014".

Thus, the important vertical rigidity of the frame is almost doubled, using no more steel, when compared with the conventional double tube frame under exactly the same load conditions.

The embodiment described and shown to illustrate the present invention has been necessarily specific for purposes of illustration. Alterations, extensions, and modifications would be apparent to those skilled in the art.

The embodiments of the invention in which an exclusive property or privilege is claimed are defined as follows:

1. A reach tube or down tube of a bicycle type exerciser, namely a tubular member joining the handlebar head tube to a lower portion of the seat tube, and having an angular configuration in side view including a rear horizontal section secured at its rear end to the seat tube and a front diagonal section extending upwardly and forwardly and secured at its front end to the head tube, the improvement wherein the reach tube is characterized in that it has less than 0.11 pounds of steel per running inch and has a vertically elongated, hollow rectangular cross section uniform along its length which has a height-to-width ratio providing a vertical rigidity enabling the top of the seat tube to deflect less than 0.0060" per 100 pound load applied vertically thereto when a rear foot plate connected to the bottom of the seat tube is clamped against horizontal movement and a front foot plate connected to the bottom of the head tube is mounted to move freely forwardly.

2. A reach tube or down tube of a bicycle type exerciser, namely a tubular member joining the handlebar head tube to a lower portion of the seat tube and having an angular configuration in side view including a rear horizontal section secured at its rear end to the seat tube and a front diagonal section extending upwardly and forwardly and secured at its front end to the seat tube, the improvement wherein said reach tube has a vertically elongated cross-section and is characterized in that at each cross-section along its length the ratio $$\frac{I_{x-x}}{I_{y-y}}$$

is in the range of about 1.75/1 to 3.75/1, where $I_{x-x}$ = the area amount of inertia about the horizontal neutral axis and $I_{y-y}$ = the area moment of inertia about the vertical neutral axis; and said reach tube or down tube is further characterized as a single tube comprising a major structural connection between the handlebar head tube and the seat tube.

* * * * *

UNITED STATES PATENT AND TRADEMARK OFFICE

CERTIFICATE OF CORRECTION

PATENT NO. : 5,046,723

DATED : September 10, 1991

INVENTOR(S) : Eugene Szymski & Rene Mraz

It is certified that error appears in the above-identified patent and that said Letters Patent is hereby corrected as shown below:

Column 6, line 26, the word "amount" should be

- moment -.

Signed and Sealed this

Fifteenth Day of December, 1992

*Attest:*

DOUGLAS B. COMER

*Attesting Officer*

*Acting Commissioner of Patents and Trademarks*